US005975065A

United States Patent [19]

Clauss et al.

[11] Patent Number: 5,975,065

[45] Date of Patent: Nov. 2, 1999

[54] VENTING ARRANGEMENT FOR AN INTERNAL COMBUSTION ENGINE

[75] Inventors: Roland Clauss, Esslingen; Georg Leipner, Hochdorf; Willy Treyz, Neckartailfingen, all of Germany

[73] Assignee: Daimler Chrysler AG, Stuttgart, Germany

[21] Appl. No.: 09/015,466

[22] Filed: Jan. 29, 1998

[30] Foreign Application Priority Data

Feb. 1, 1997 [DE] Germany ..... 197 03 771

[51] Int. Cl.[6] ..... F01M 13/04

[52] U.S. Cl. ..... 123/573

[58] Field of Search ..... 123/572, 573, 123/574

[56] References Cited

U.S. PATENT DOCUMENTS

| | | | |
|---|---|---|---|
| 4,501,234 | 2/1985 | Toki et al. | 123/573 |
| 4,502,424 | 3/1985 | Katoh et al. | 123/573 |
| 5,622,156 | 4/1997 | Rose et al. | 123/573 |
| 5,690,084 | 11/1997 | Gunji et al. | 123/572 |
| 5,697,350 | 12/1997 | Brutsch et al. | 123/572 |

FOREIGN PATENT DOCUMENTS

| | | |
|---|---|---|
| 0 454 512 | 10/1991 | European Pat. Off. . |
| 0 471 886 | 2/1992 | European Pat. Off. . |
| 0 732 484 | 9/1996 | European Pat. Off. . |
| 23 41 267 | 3/1975 | Germany . |
| 31 28 470 | 1/1983 | Germany . |
| 31 52 747 | 1/1984 | Germany . |
| 36 18 557 | 12/1986 | Germany . |
| 2 155 998 | 10/1985 | United Kingdom . |

*Primary Examiner*—Marguerite McMahon
*Attorney, Agent, or Firm*—Klaus J. Bach

[57] ABSTRACT

In a venting arrangement for an internal combustion engine including a crankcase with a cylinder block, a cylinder head mounted on the cylinder block, a cylinder head cover mounted onto the cylinder head, and an oil separator integrally formed with the cylinder head cover, the oil droplets contained in the vent gases are separated from the vent gases as the vent gases are drawn through the oil separator and the oil-free vent gases are then supplied to the engine air intake duct. The oil is collected and drained by way of a siphon consisting of a cavity formed in the cylinder head and a drain pipe extending from the oil separator in the cylinder head cover into the cavity which, at its bottom, includes a bore through which a cylinder head bolt extends for mounting the cylinder head onto the cylinder block.

9 Claims, 2 Drawing Sheets

VENTING ARRANGEMENT FOR AN INTERNAL COMBUSTION ENGINE

BACKGROUND OF THE INVENTION

The invention relates to a venting arrangement for the crankcase of an internal combustion engine including a cylinder head and a cylinder head cover with an oil separator which is integrally formed with the cylinder head cover.

D 41 18 557 A1 discloses such a venting arrangement for the crankcase of an internal combustion engine. The cylinder head cover includes two integrally formed oil separators which have collection cavities and are arranged opposite one another with respect to the longitudinal engine axis. A siphon-like duct structure extends from each collection cavity to the camshaft space. During venting the vent gases escaping the crankcase flow, by way of the camshaft space, to the oil separators. The oil separated from the vent gases is collected in the collection cavities and then flows into the camshaft space via the duct structure. From there, it is returned to the crankcase by way of an oil return passage. The oil-free vent gases are supplied to the intake system of the internal combustion engine.

For general technical background information reference is made to EP 0 732 484 A1 and D 37 13 210 C2.

It is the object of the present invention to provide a venting arrangement including a siphon which can be inexpensively made, which is easy to assemble and which does not require additional space.

SUMMARY OF THE INVENTION

In a venting arrangement for an internal combustion engine including a crankcase with a cylinder block, a cylinder head mounted on the cylinder block, a cylinder head cover mounted onto the cylinder head, and an oil separator integrally formed with the cylinder head cover, the oil droplets contained in the vent gases are separated from the vent gases as the vent gases are drawn through the oil separator and the oil-free vent gases are then supplied to the engine air intake duct. The oil is collected and drained by way of a siphon consisting of a cavity formed in the cylinder head and a drain pipe extending from the oil separator in the cylinder head cover into the cavity which, at its bottom, includes a bore through which a cylinder head bolt extends for mounting the cylinder head onto the cylinder block.

It is an important advantage of the invention that very little space is required for the venting arrangement according to the invention so that the height of the engine is not increased. The cavity of the siphon in which the oil is collected is disposed in the cylinder head and requires no additional space. The cylinder head cover can be very flat. The cavity provides for a sufficiently large oil collection volume which is kept filled by the oil draining from the oil separator such that the siphon effect is always maintained. With the arrangement of the siphon as provided by the present invention, no expensive manufacturing procedures such as bending are required. And since upon mounting of the cylinder head cover onto the cylinder head, the oil drain pipe is automatically inserted into the cavity in the cylinder head, the installation of the venting arrangement is also very simple.

Preferably, the oil collection cavity is formed by a bore receiving he head of a cylinder head bolt which bore is needed anyway so that no additional cavity is needed nor needs to be made.

Preferably, the drain pipe is molded or cast integrally with the oil separator integrally formed with the cylinder head cover, that is, it is formed during the molding or casting process of the cylinder head cover but it may also be formed separately and pressed into the oil separator. In any case, the drain pipe does not need to be separately mounted at a later point.

The cover part of the oil separator preferably includes guide ribs extending diagonally to the longitudinal extension of the engine in the direction toward the drain pipes which conduct the oil separated from the vent gases in the oil separator to the drain pipe leading to the siphon.

Preferably, the oil separator includes in its bottom part weirs which extend also transverse to the longitudinal direction of the engine and which prevent oil separated from the vent gases from being drawn in the direction of the air outlet.

By providing partitions in the entrance area for the vent gases into the oil separator, spray oil is prevented from entering the oil separator from the cylinder head.

Further embodiments and advantages of the invention will become apparent from the following description of an embodiment thereof on the basis of the accompanying drawings.

DESCRIPTION OF A PREFERRED EMBODIMENT

Figure 1:
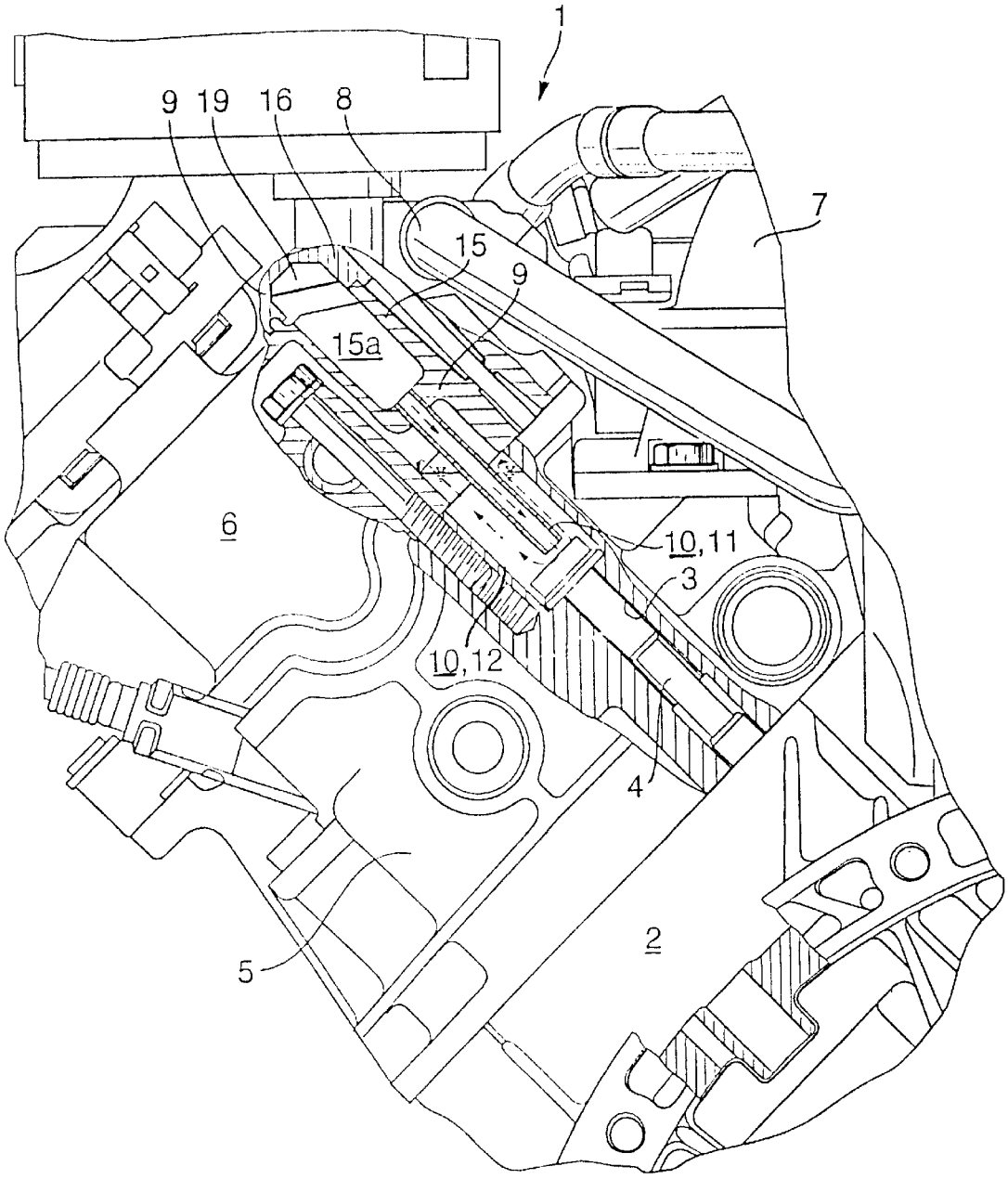
FIG. 1 shows a part of an internal combustion engine as seen from the output shaft end of the engine wherein the venting arrangement according to the invention is seen in a partial sectional view. The venting arrangement as shown includes a vent line connected to the air intake duct of the engine, an oil separator integrated into the cylinder head cover and a siphon comprising a drain pipe and a cavity. The oil separator includes a bottom part and a lid part with guide rib structures for guiding the flow of the oil separated from the vent gases.

FIG. 1 shows the venting arrangement 1 according to invention for a crankcase/cylinder block 2 of an internal combustion engine with two cylinder banks which are arranged in a V-shape, but of which only one is shown. However, the venting arrangement may also be used with single-bank inline engines. A cylinder head 5 is mounted on the cylinder block 2 by cylinder head bolts 4 extending through bores 3. The cylinder head 5 is covered by a cylinder head cover 6.

Figure 2:
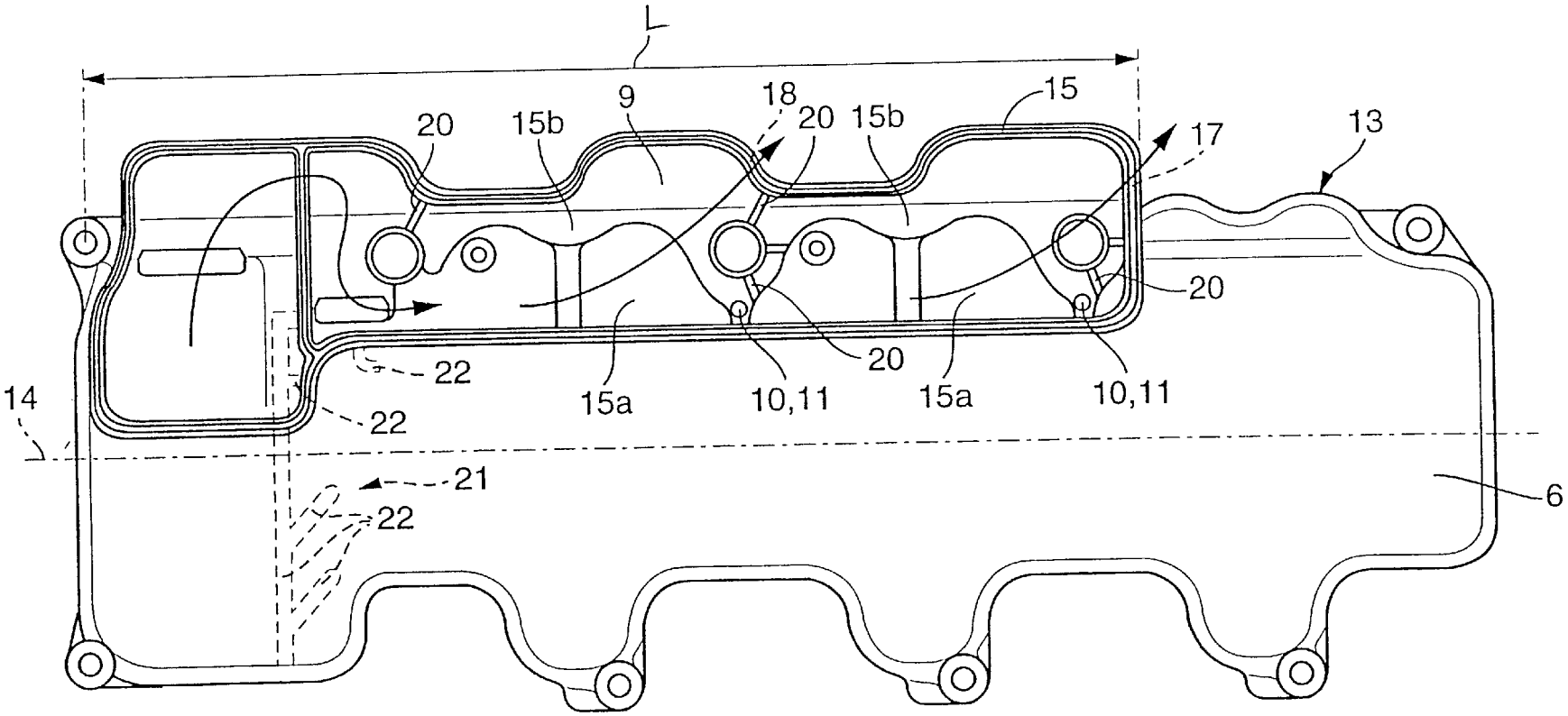
FIG. 2 is a top view of the cylinder head cover showing the lower part of the oil separator which is integrally formed with the cylinder head cover and includes some weirs for retaining the oil.

The venting arrangement 1 includes a vent line 8 connected to the air intake duct 7 of the internal combustion engine, an oil separator 9 which is disposed in the vent line 8 and is integrally formed with the cylinder head cover 6 and a siphon 10. The vent line 8 is connected to the crankcase of the engine in a manner not shown in the drawings. For venting, the vent gases developing in the crankcase during operation of the internal combustion engine are conducted out of the crankcase 2 and to the oil separator 9. The oil particles carried along with the vent gases are separated in the oil separator 9 and are returned, by way of the siphon 10 and return passages from the cylinder head 5 to the crankcase 2 that is to an oil pan at the lower end of the crankcase 2 which is also not shown in the drawings. The oil-free vent gases leaving the oil separator 9 are supplied to the air intake duct 7 of the internal combustion engine from where they are inducted into the combustion chambers and subjected to the combustion process. In FIGS. 1 and 2, the vent gas flow is indicated by full-line arrows whereas the oil return flow is indicated by dashed arrows.

The siphon 10 includes a drain pipe 11 and an oil level maintaining element 12 wherein the oil level maintaining element comprises a recess formed (drilled or cast) into the cylinder head. In the arrangement as shown in FIG. 1, the recess at the same time receives the cylinder head bolt 4 and the bore 4 through which the cylinder head bolt 3 extends is in axial alignment with the oil level maintaining recess 12. The drain pipe 11 of the siphon 10 is connected to the oil separator 9. Preferably, the drain pipe 11 is cast or molded integrally with the oil separator 9 but it may also be pressed into the oil separator 9. It extends into the recess 12 for the cylinder head bolt 4 so that it is immersed into oil collected therein. The recess 12 may also be cast into the cylinder head. As a result, the oil separated in the oil separator 9 is drained, by way of the drain pipe 11, into the recess 13 of the cylinder head bolt 4 forming the syphon. From the siphon, the oil is returned to the oil pan by way of the cylinder head 5, the cylinder block and the crankcase which is formed integrally with the cylinder block. As shown in FIG. 2, preferably several drain pipes 11 are distributed over the length L of the oil separator 9. The recess 3 provides for a sufficient depth of the siphon 10 so that the oil collected therein can form a sufficiently high oil column forming a liquid trap which prevents passage of the vent gases through the drain pipe 11. The recess 12 is maintained filled by the oil draining from the oil separator 9, the excess oil flowing over the top edge of the recess 12 and returns to the oil circuit.

FIG. 2 shows a part of the oil separator 9 formed integrally with the cylinder head cover 6. The oil separator is arranged at the side 13 of the cylinder head cover 6 adjacent the engine air intake system 7 and extends in the direction of the longitudinal axis 14 of the engine. The oil separator 9 comprises a bottom part 15 which is formed integrally with the cylinder head cover 6 and a lid 16 disposed on the bottom part 15. The oil separator 9 is a volume separator with relatively large cross-section and long travel paths for the vent gases to calm the oil containing vent gases to facilitate the separation of oil therefrom. The bottom part 15 and the lid 16 form a box-like housing in which baffles 15*a* are so arranged that the vent gas flow entering the oil separator is deflected several times. The baffles 15*a* form impingement plates which are inclined with respect to a drain passage 15*b* formed in the housing bottom part 15. The oil particles of the vent gases impinge on the impingement surfaces 15*a*, are deposited thereon and then drain, by way of the drain passage 15*b*, into the drain pipe 11 of the siphon 10. The inner walls of the oil separator 9 are rough in order to provide for good adhesion of the oil droplets deposited thereon.

The lid 16 has at its rear end a vent gas discharge 17 which mainly serves as an auxiliary vent gas discharge during full load operation of the engine and another vent gas discharge 18 arranged at the side of the lid which is utilized during partial load engine operation. Both are connected to the engine air intake system 7. The venting system 1 is operative for venting during full engine load, during partial engine load or during mixed operation of the internal combustion engine or with a combination as it is the case for the present arrangement. At the inside, the lid 16 is provided with guide ribs 19 which extend in a direction diagonally to the longitudinal engine axis 14 and which guide the oil deposited thereon to the drain pipes 11 (see FIG. 1). The bottom part 15 of the oil separator 9 also includes means 20 which extend at various angles to the longitudinal engine axis and which prevent the oil from being drawn by the vent gas flow toward the air discharges 17, 18.

Both air discharges 17, 18 in the lid 16 of the oil separator 9 are disposed, in a position of the engine as installed, at a higher level than the oil entrance openings to the drain pipes 11 in the bottom part 15 of the oil separator. As a result, in cooperation with the weirs 20 arranged in the bottom part 15 of the oil separator 9 for retaining the oil, the oil deposited in the oil separator will not enter the engine air intake system 7, but will leave the oil separator 9 by way of the drain pipes 11. In the area 21, where the vent gases enter the oil separator 9, the cylinder head cover 6 includes baffle plates 22 which prevent spray oil from the chain drive of the camshafts from entering the oil separator 9. The position of the baffle plates 9 depends on the direction of movement of the drive chain. The baffle plates 22 are so arranged that the spray oil is intercepted by the baffle plates 22 and kept away from the oil separator 9.

What is claimed is:

1. A venting arrangement for an internal combustion engine including a crankcase with a cylinder block and a cylinder head mounted on said cylinder block, a cylinder head cover mounted on said cylinder head, an oil separator integrally formed on said cylinder head cover, an air intake system connected to said cylinder head for supplying fresh air to said engine, said crankcase and cylinder block including vent passages for conducting vent gases including oil droplets to said oil separator in said cylinder head cover, a vent line for conducting oil droplet-free vent gases from said oil separator to said air intake system and a siphon with a cavity formed in said cylinder head and an oil drain pipe extending from said oil separator into said cavity with its end being immersed into oil collected in said cavity so as to prevent vent gases from flowing through said drain pipe, said cavity being a recess formed into said cylinder head for receiving a cylinder head mounting bolt, and said recess having at its bottom a bore through which said cylinder head mounting bolt extends into said cylinder block.

2. A venting arrangement according to claim 1, wherein said cavity is a recess formed into said cylinder head for receiving a cylinder head mounting bolt, said recess having at its bottom a bore through which said cylinder head mounting bolt extends into said cylinder block.

3. A venting arrangement according to claim 1, wherein several oil drain pipes extend from said oil separator, said drain pipes being distributed over the length of said oil separator.

4. A venting arrangement according to claim 1, wherein said oil drain pipe is integrally formed with said oil separator.

5. A venting arrangement according to claim 1, wherein said oil drain pipe is pressed into said oil separator.

6. A venting arrangement according to claim 1, wherein said oil separator includes a bottom part formed integrally with said cylinder head cover and a lid mounted onto said bottom part.

7. A venting arrangement according to claim 1, wherein guide ribs are provided on said lid for guiding the oil separated in said oil separator.

8. A venting arrangement according to claim 6, wherein said oil separator includes in its bottom part weirs for retaining oil collected in said oil separator.

9. A venting arrangement according to claim 1, wherein, in the entrance area of said vent gases into said oil separator, said cylinderhead cover includes baffles which prevent spray oil from said cylinder head cover interior to enter said oil separator.

* * * * *